United States Patent [19]

Rosenberg

[11] 3,958,760

[45] May 25, 1976

[54] SPRAY NOZZLE

[76] Inventor: Peretz Rosenberg, Moshav Beit Shearim, Israel

[22] Filed: Sept. 30, 1975

[21] Appl. No.: 618,283

[30] Foreign Application Priority Data

Oct. 23, 1974 Israel ..... 45916

[52] U.S. Cl. ..... 239/453; 239/524

[51] Int. Cl.[2] ..... B05B 1/30; B05B 1/26

[58] Field of Search ..... 239/4, 381–383, 239/389, 101, 102, 222.11, 222.17, 453, 222.21, 454, 505, 524, 512, DIG. 20

[56] References Cited

UNITED STATES PATENTS

| | | | |
|---|---|---|---|
| 459,449 | 9/1891 | Smith | 239/524 X |
| 2,448,472 | 8/1948 | Schott | 239/505 |
| 2,589,942 | 3/1952 | Hruby | 239/382 |

FOREIGN PATENTS OR APPLICATIONS

| | | | |
|---|---|---|---|
| 1,028,521 | 5/1966 | United Kingdom | 239/524 |

*Primary Examiner*—Robert S. Ward, Jr.
*Attorney, Agent, or Firm*—Benjamin J. Barish

[57] ABSTRACT

Spray nozzles are described comprising a floating deflector supported close to and in alignment with the nozzle orifice so as to be impinged by the jet issuing therefrom, the deflector being floatingly mounted so as to be movable laterally of, towards, and away from the nozzle orifice, and being formed with a central recess on the face thereof impinged by the jet effective to automatically self-center the deflector with respect to the orifice. The nozzle further includes limiting means limiting the floating movement of the deflector with respect to the nozzle orifice.

10 Claims, 6 Drawing Figures

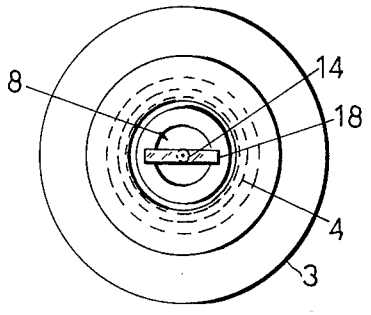
FIG. 2
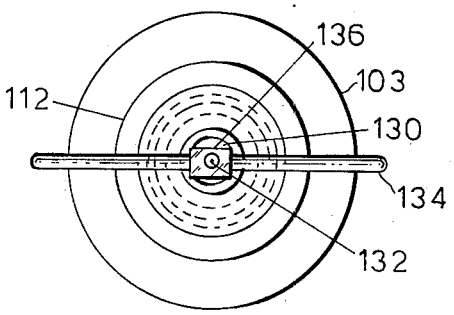
FIG. 4
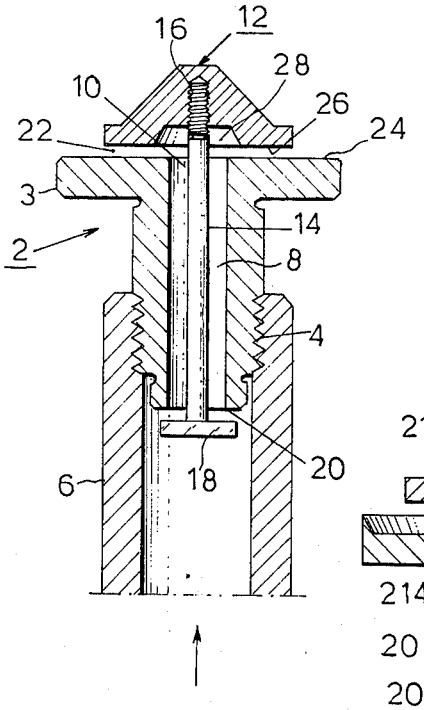
FIG. 1
FIG. 3
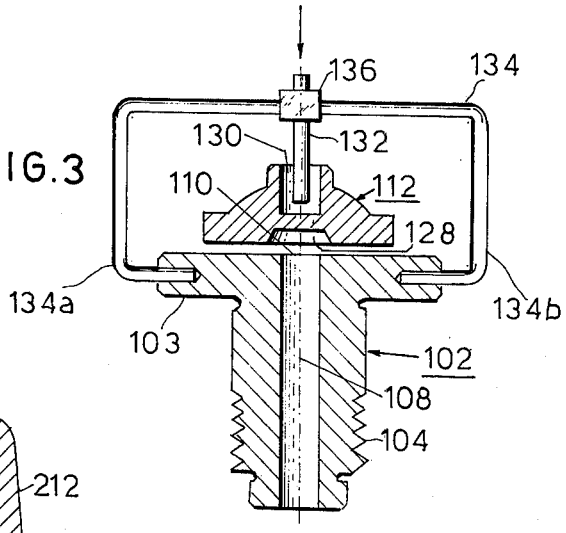
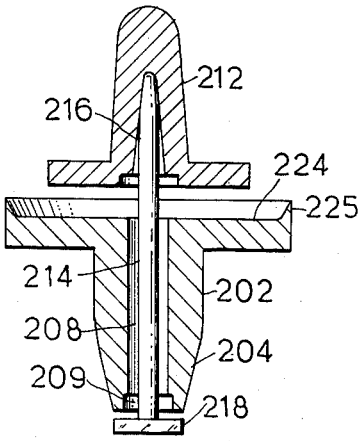
FIG. 5
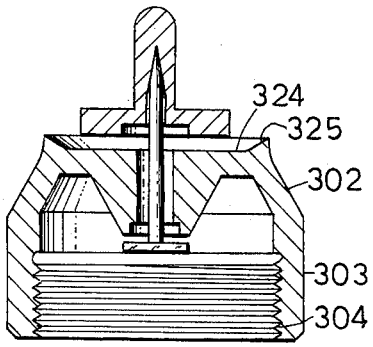
FIG. 6

SPRAY NOZZLE

BACKGROUND OF THE INVENTION

The present invention relates to spray-nozzles such as are used for producing a fine spray, mist, or diffusion of a fluid, particularly a liquid such as water, about the nozzle orifice. The invention is particularly useful in water spray nozzles such as are used for irrigation purposes, and is therefore described below with respect to that application, but it will be appreciated that the invention could be advantageously used in other applications as well.

Spray nozzles such as are used for water irrigation purposes commonly include a nozzle head formed with an outlet orifice through which the water issues in the form of a jet, and a deflector mounted close to and in alignment with the nozzle orifice so as to be impinged by the jet, the deflector thereby producing an annular spray of water around the nozzle orifice. In this type of spray nozzle the deflector must be precisely positioned with respect to the nozzle orifice to assure a uniform distribution of the issuing spray around the nozzle. This type of nozzle therefore requires costly precision in the manufacture and assembly of the parts. Such nozzles are also very intolerant of wear or misalignment of parts during use, which necessitates their frequent adjustment, repair, and replacement. Further, this type of nozzle commonly includes small openings which can be easily clogged both during use by foreign particles in the water, and also during non-use by insects or dirt particles settling thereon from the air.

SUMMARY OF THE INVENTION

An object of the present invention is to provide a new form of spray-nozzle having advantages in the above respects.

According to the present invention, there is provided a spraying device comprising a nozzle formed with an outlet orifice through which the fluid issues in the form of a jet, and a deflector supported close to and in alignment with the nozzle orifice so as to be impinged by the jet issuing therefrom. The deflector is floatingly mounted with respect to the nozzle so as to be movable in a lateral direction with respect to its orifice, and is formed with a recess centrally of the face thereof impinged by the jet which recess is effective to automatically self-centre the deflector with respect to the orifice upon the issuance of the jet therefrom. The nozzle further includes limiting means limiting the floating movement of the deflector with respect to the nozzle orifice.

According to another feature of the preferred embodiments of the invention described below, the floatingly mounted deflector is also movable inwardly and outwardly towards and away from the nozzle orifice, and is biased to close the nozzle orifice upon the termination of the issuance of the jet therefrom.

In one described embodiment of the invention, the limiting means comprises a rod of smaller diameter than the nozzle orifice and passing therethrough, the outer end of the rod being attached to the deflector and the inner end of the rod including a stop limiting the outward movement of the rod and deflector with respect to the nozzle orifice.

In a second described embodiment of the invention, the deflector includes a second recess on the face thereof opposite to the first recess, and the limiting means comprises a first portion attached to the nozzle, and a second portion seatable within the second recess of the deflector, the latter recess being of larger dimensions than said second portion of the limiting means to permit said floating movement of the deflector with respect to the nozzle orifice.

As will be more clearly shown by the description below, spray-nozzles constructed in accordance with the foregoing features may be made of a few simple parts not requiring precision in their manufacture or in their assembly. Further, the nozzle is not easily clogged by foreign particles in the water during use, and it automatically closes the orifice during non-use to prevent clogging by insects or dirt particles in the air.

Further features and advantages of the invention will be apparent from the description below.

BRIEF DESCRIPTION OF THE DRAWINGS

The invention is herein described, by way of example only, with reference to two preferred embodiments illustrated in the accompanying drawings, wherein:

FIG. 1 is longitudinal sectional view of one form of spray-nozzle constructed in accordance with the invention, the nozzle being attached to a water supply pipe;

FIG. 2 is a bottom plan view of the nozzle of FIG. 1;

FIG. 3 is a longitudinal sectional view of a second form of spray-nozzle constructed in accordance with the invention;

FIG. 4 is a top plan view of the spray-nozzle of FIG. 3; and

FIGS. 5 and 6 are longitudinal sectional views of two further forms of nozzles constructed in accordance with the invention.

DESCRIPTION OF THE PREFERRED EMBODIMENTS

The spray-nozzle illustrated in FIGS. 1 and 2, generally designated 2, includes an enlarged upper head 3 and a lower threaded end 4 for attachment to a water supply pipe 6. Formed through the nozzle is an axial bore 8 communicating at one end with water supply pipe 6 and terminating at the opposite end in an outlet orifice 10 through which the water issues in the form of a jet.

A deflector 12 in the form of a circular cap is supported close to and in alignment with nozzle orifice 10 so as to be impinged by the jet issuing therefrom. Deflector 12 is floatingly mounted by means of a rod 14 passing through nozzle bore 8. Rod 14 is of smaller diameter and of greater length than the nozzle bore, and its outer end is secured centrally of deflector 12, as by threading at 16. The inner end of the rod is formed with a cross-bar 18 of greater length than the diameter of bore 8 so as to limit against the lower face 20 of the nozzle.

It will be seen that rod 14 provides a floating mounting for deflector 12, permitting the deflector to move in a lateral direction with respect to the nozzle orifice 10, and also inwardly and outwardly towards and away from the nozzle orifice.

The face 24 of nozzle 2 is flat, as is also the confronting face 26 of the deflector 12 except for a circular recess 28 formed centrally of the deflector. Recess 28 is of slightly larger diameter than that of the nozzle orifice 10 and is aligned with that orifice so that the water jet issuing from the latter impinges within the recess. As shown, the side walls of recess 28 are preferably tapered inwardly.

In use, the nozzle 2 is threaded onto the water supply pipe 6. When the water supply is turned-off, deflector 12, being biased by gravity, moves against face 24 of the nozzle, thereby closing its orifice 10. Accordingly, when not in use the orifice is automatically closed against the possible entry of insects or dust particles which might clog it.

As soon as the water supply is turned-on, the water jet issuing through orifice 10 of the nozzle impinges the recess portion 28 of deflector 12 and is then deflected laterally in all directions through space 22, the deflector having moved upwardly by the force of the water jet until cross-bar 18 abuts against face 20 of the nozzle. It has been found that the provision of recess 28, in which the water jet impinges, effects an automatic self-centering of deflector 12 with respect to the nozzle orifice 10 so that the deflector is continuously maintained in the proper centered position with respect to the orifice to assure a uniform distribution of the issuing spray around the nozzle. Thus, if deflector 12 should tend to move laterally or tip in one direction or the other with respect to nozzle orifice 10 (which might produce a greater quantity of water spray from one side of the nozzle than from another), a force is produced by the water jet on the deflector which automatically corrects the lateral displacement or tipping of the deflector, and returns it to its proper central position to provide the uniform spray distribution.

Thus, the embodiment of the invention illustrated in FIGS. 1 and 2 provides a spray-nozzle having a floating deflector which automatically self-centers itself with respect to the nozzle orifice during use to assure a uniform distribution of the spray, which automatically closes the nozzle orifice when the water supply is turned-off to prevent clogging by insects or dust particles, which does not contain small openings easily cloggable by foreign particles in the water supply, and which can be produced with few and simple parts that can be manufactured, assembled and maintained at low cost.

As one example of a design that has been constructed and found to work very satisfactorily, the diameter of nozzle orifice 10 may be 2 mm, that of rod 14 may be 1 mm, that of recess 28 may be 2.5 mm, and the space 22 between face 26 of the deflector and space 24 of the nozzle, in the outermost position of the deflector, may be 0.5 mm.

FIGS. 3 and 4 illustrate a second embodiment of the invention including a variation in the means for limiting the movement of the floating deflector. To facilitate comparison of this embodiment with that of FIGS. 1 and 2, similar parts are correspondingly numbered but raised by "100".

Thus, the nozzle 102 of the embodiment of FIGS. 3 and 4 is similarly formed with an enlarged head 103 at one end, attaching threads 104 at the opposite end, and an axial bore 108 terminating in an outlet orifice 110. The deflector 112 is of a similar cap-like configuration and includes a central circular recess 128 aligned with nozzle orifice 110. Instead of using a rod (14) for limiting the floating movement of the deflector (as in FIGS. 1 and 2), the opposite (to recess 128) face of deflector 112 is formed with a second circular central recess 130, which receives a straight rod 132 carried centrally of a U-shaped rod 134 whose legs 134a, 134b are attached to head 103 of the nozzle. U-shaped rod 134 may be of spring wire whose outer legs are snapped into openings formed in nozzle head 103, and rod 132 may be secured to the centre of U-shaped rod 134 by means of a rod clamp 136.

Deflector 112 is inserted to freely rest, by gravity, on the upper face of nozzle 102, and its movements are restrained only by rod 132 seated within the deflector recess 130. Recess 130 is of larger diameter than rod 132, so that the deflector may move laterally of nozzle orifice 110; also, the lower end of rod 132 is supported above the bottom surface of recess 130, so that the deflector may also move towards and away from the nozzle orifice. A very simple arrangement is thus provided for floatingly supporting deflector 112 with respect to nozzle orifice 110, enabling the deflector to move laterally of, towards, and away from the nozzle orifice as described in the embodiment of FIGS. 1 and 2.

In the embodiments illustrated in FIGS. 1–4, the confronting deflector and nozzle faces are illustrated as being flat, except for the recess in the deflector face. This construction is particularly useful for horizontal spraying, for example under-tree irrigation.

FIGS. 5 and 6 illustrate two further variations particularly useful for inclined spraying. Thus, in FIG. 5 the nozzle face 224 is flat except that its outer marginal rim 225 is upwardly inclined, for example at an angle of about 30°–45°, to provide inclined spraying. In addition, the upper end 216 of rod 214 is tapered for press-fitting same into a similarly tapered bore in deflector 212. Further, the lower end 204 of the nozzle may similarly be tapered for press-fitting same into a similarly tapered opening in the supply pipe (not shown). In addition, the lower end 209 of bore 208 is enlarged to minimize the possibility of its being clogged by foreign particles in the water when engaged by cross-bar 218 of rod 214. In FIG. 6, the flat face 324 of nozzle 302 is also upwardly inclined at its marginal edge 325. In this case, the nozzle is integrally formed with a sleeve 303 internally threaded at 304 for attachment to the water supply (not shown).

In all other respects the structure and operation of the nozzles of FIGS. 5 and 6 are the same as described above with respect to FIGS. 1–4.

What is claimed is:

1. A spraying device comprising a nozzle formed with an outlet orifice through which the fluid issues in the form of a jet; a deflector supported close to and in alignment with the nozzle orifice so as to be impinged by the jet issuing therefrom; said deflector being floatingly mounted with respect to the nozzle so as to be movable in a lateral direction with respect to its orifice; said deflector being formed with a recess centrally of the face thereof impinged by the jet which recess is effective to automatically selfcentre the deflector with respect to the orifice upon the issuance of the jet therefrom; and limiting means limiting the floating movement of the deflector with respect to the nozzle orifice.

2. A device according to claim 1, wherein said floatingly mounting deflector is also movable inwardly and outwardly towards and away from the nozzle orifice, and is biased to close the nozzle orifice upon the termination of the issuance of the jet therefrom.

3. A device according to claim 2, wherein said floatingly mounted deflector overlies the nozzle orifice and is biassed to close same by gravity.

4. A device according to claim 1, wherein said recess in the deflector is of slightly larger diameter than the nozzle orifice.

5. A device according to claim 1, wherein the limiting means comprises a rod of smaller diameter than the nozzle orifice and passing therethrough, the outer end of the rod being attached to the deflector and the inner end of the rod including a stop limiting the outward movement of the rod and deflector with respect to the nozzle orifice.

6. A device according to claim 5, wherein said stop includes a cross-bar carried at the inner end of the rod to limit the outward movement thereof while permitting the fluid to pass therearound to the nozzle orifice.

7. A device according to claim 6, wherein the deflector includes a second recess formed on the face thereof opposite to the first recess, and wherein the limiting means comprises a first portion attached to the nozzle, and a second portion seatable within the second recess of the deflector, the latter recess being of larger dimensions than said second portion of the limiting means to permit said floating movement of the deflector with respect to the nozzle orifice.

8. A device according to claim 7, wherein said first portion of the limiting means includes a U-shaped rod in which the two legs of the rod are attached to the nozzle, and said second portion of the limiting means includes a second rod carried by the U-shaped rod and seatable within the second recess of the deflector.

9. A device according to claim 1, wherein the face of the deflector facing the nozzle orifice is substantially flat except for the recess formed therein and is of smaller outer diameter than the confronting face of the nozzle having the outlet orifice.

10. A device according to claim 9, wherein said confronting face of the nozzle having the orifice is also substantially flat but is formed with an upwardly inclined surface at its outer margin.

* * * * *